US006065643A

United States Patent [19]

Harvey et al.

[11] Patent Number: 6,065,643

[45] Date of Patent: May 23, 2000

[54] TWO-COMPARTMENT CONTAINER

[75] Inventors: John W. Harvey; John D. Sawkins, both of Essex, United Kingdom

[73] Assignee: Betts UK Limited, Essex, United Kingdom

[21] Appl. No.: 09/068,766

[22] PCT Filed: Nov. 6, 1996

[86] PCT No.: PCT/GB96/02722

§ 371 Date: Jul. 21, 1998

§ 102(e) Date: Jul. 21, 1998

[87] PCT Pub. No.: WO97/18144

PCT Pub. Date: May 22, 1997

[30] Foreign Application Priority Data

Nov. 14, 1995 [GB] United Kingdom ..... 9523230

[51] Int. Cl.[7] ..... B65D 35/22

[52] U.S. Cl. ..... 222/94

[58] Field of Search ..... 222/94, 96, 107, 222/129, 484, 545, 556

[56] References Cited

U.S. PATENT DOCUMENTS

| | | | |
|---|---|---|---|
| 3,172,571 | 3/1965 | Marchak | 222/107 |
| 3,782,600 | 1/1974 | Columbus | 222/94 |
| 4,687,663 | 8/1987 | Scheaffer | 222/94 X |
| 4,974,756 | 12/1990 | Pearson et al. | 222/94 X |
| 5,147,072 | 9/1992 | Dirksing | 222/484 X |
| 5,318,203 | 6/1994 | Iaia et al. | 222/94 |
| 5,702,033 | 12/1997 | Beaver | 222/94 |

FOREIGN PATENT DOCUMENTS

| | | |
|---|---|---|
| 0 465 391 | 1/1992 | European Pat. Off. . |
| 1.476.134 | 4/1967 | France . |
| 366638 | 6/1923 | Germany . |
| 37 42 692 | 6/1988 | Germany . |
| WO 94/19251 | 9/1994 | WIPO . |

*Primary Examiner*—Kevin Shaver
*Assistant Examiner*—Thach Bui
*Attorney, Agent, or Firm*—Nixon & Vanderhye P.C.

[57] ABSTRACT

A two-compartment container (10) comprises two flexible "D" shaped cross section tubular housings (11) each having a respective shoulder (17) with a nozzle (25). The two tubular housings (11) each have a flat portion (14) and an arcuate portion (15) and are held in side-by-side relationship so that the flat portions (14) are in contact over substantially their entire widths and lengths.

13 Claims, 3 Drawing Sheets

TWO-COMPARTMENT CONTAINER

BACKGROUND OF THE INVENTION

1. Field of the Invention

This invention relates to two-compartment containers and in particular to collapsible containers used for holding two materials which can interact with each other.

2. Description of the Related Art

In U.S. Pat. No. 4,528,180, there is disclosed a dental preparation comprising two separately stored dental preparations which are used in combination on expulsion from their respective containers, for example a hydrogen peroxide gel which reacts when combined with a paste containing sodium bicarbonate, salt or other cleaning and polishing agents.

In U.S. Pat. No. 4,528,180 the two preparations are stored in two collapsible tubular housings arranged side-by-side with their outlet nozzles being interconnected, or merely being adjacent each other so that the materials mix on expulsion from the two compartments. Other two-compartment containers are shown in U.S. Pat. No. 5,318,203 and in WO 94/19251, in both of which the compartments are formed from separate circular tubes, each of which is distorted at one end to conform with the shape of a coupling having an outlet nozzle, the other ends being sealed into a "fish tail" closure by a common welded seam. In the above examples the tubes change their cross-sectional shape from a generally 'D' shape at the couplings through an oval shape to a generally flat shape at the closure seam. Thus there is no consistent contact between the flexible tubes ensuring a consistency in the ratio of the two materials expelled from the compartments when the tubes are squeezed.

The present invention provides an improved two-compartment container.

SUMMARY OF THE INVENTION

Accordingly there is provided a two-compartment container for paste or other thixotropic material comprising two flexible tubular plastics housings each having a shoulder piece with a discharge nozzle therein located at one end thereof with the other ends of the two tubular housings being formed into a closure seam, which is characterised in that the two tubular housings each have a substantially D-shaped cross-section with a substantially flat planar portion located between two longitudinally extending corners which extend the whole length of the tube, the two tubular housings being held in side-by-side relationship so that the flat planar portions are in contact with each other over substantially their entire widths and lengths.

Also according to the invention there is provided a two-compartment container for paste or other thixotropic material comprising two flexible tubular housings arranged side-by-side and each having a shoulder piece with a discharge nozzle therein located at one end of the tubular housing, which is characterised in that the two tubular housings each have a D-shaped cross-section and the two shoulder pieces each comprises a D-shaped skirt which is locatable within the tubular housings and at its upper end extends into a shoulder which extends inwardly, each tubular housing being heat-formed and welded to a respective shoulder.

Yet another aspect of the invention provides a two-compartment container for paste or other thixotropic material comprising two compartments arranged side-by-side and each having a discharge nozzle at one end thereof, the two nozzles being a snap-fit into a cap, which is characterised in that each nozzle has an inwardly projecting lip adjacent the mouth thereof.

Yet another aspect of the invention provides a two-compartment container for paste or other thixotropic material comprising two compartments arranged side-by-side and each having a shoulder piece with a discharge nozzle therein at one end of the respective compartment, the two nozzles being a snap-fit into a cap, said cap having a skirt which surrounds and supports said shoulder pieces after assembly of the two nozzles to the cap.

A further aspect of the invention provides a two-compartment container for paste or other thixotropic material comprising two compartments arranged side-by-side and each having a discharge nozzle at one end thereof, the two nozzles being a snap-fit engagement into a respective outlet passageway in a cap, each outlet passageway having a mouth projecting downwardly of the cap into which the nozzle is inserted, the mouth having detent means for effecting the snap-fit engagement of a respective nozzle and which is located at the distal end of the mouth.

The tubular housing is preferably formed from laminated plastics material, preferably from a laminated strip which is rolled into a tube so that its longitudinal edges overlap and are welded into a seam. The tube is then passed through apparatus, of the type disclosed in our U.S. Pat. No. 5,942,071 issued to Sawkins (a co-inventor of the present application) on Aug. 24, 1999 and herein incorporated by reference, to convert the substantially circular cross-sectioned tube into a D-section tube having a pair of longitudinally extending creases with a substantially flat portion extending between the creases in one direction and an arcuate portion extending between the creases in the other direction.

Yet another aspect of the invention comprises a closure for a two-compartment container of the type in which a circular closure outlet is divided into two passageways by a partition, and a lid associated with the closure has on its side adjacent the outlet, two concentric radially spaced annular sidewalls which in use seal against the inner and outer surfaces of the outlet, and a pair of diametrical spaced walls which seal one on each side of the partition wall.

BRIEF DESCRIPTION OF THE DRAWINGS

The invention will now be further described, by way of example, with reference to the accompanying drawings, in which.

DESCRIPTION OF PREFERRED EMBODIMENTS

Figure 1:
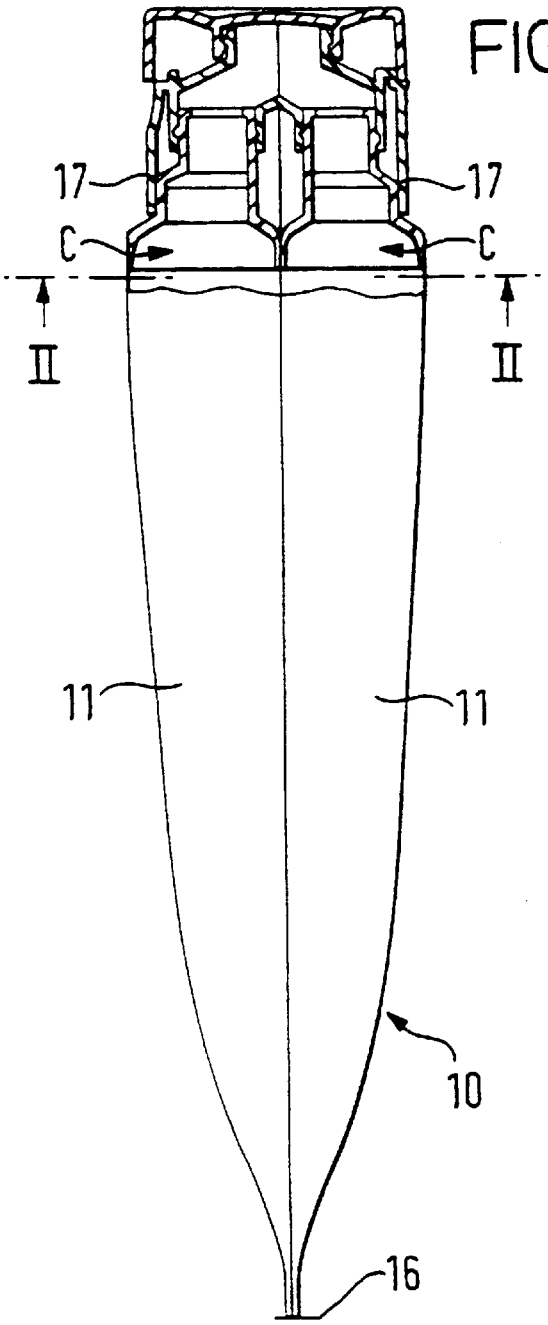
FIG. 1 is a longitudinal partially sectioned view through a two-compartment container according to the present invention.
Figure 2:
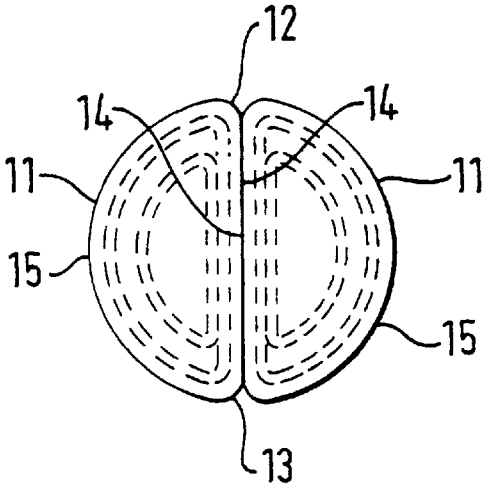
FIG. 2 is a cross-section on the line II—II of FIG. 1.

Now with reference to FIG. 1 there is shown a two-compartment container 10 for the storage of two different material compositions which are stored separately and which are mixed or put together at the point of delivery from the container. Typical materials might be dental preparations, food pastes, or two-part adhesives.

The container 10 comprises two compartments 'C' formed in two flexible tubular housings 11 which are substantially D-shaped in cross-section with a pair of longitudinally extending creases 12 and 13 having between them on one side a substantially flat planar portion 14 and on the other side an arcuate portion 15.

The two tubular housings 11 are preferably formed from flat flexible plastic strip, typically with a wall thickness of between 0.2 and 0.5 mm and comprising a laminate of several layers of different plastics materials including a vapour-impermeable barrier which is typically a layer of a plastics material or a layer of aluminium foil. The strip is generally formed from high density polyethylene based materials and the barrier layer is generally based on an ethylene vinyl alcohol material. The strip is folded into a round or oval shape with overlapping edges of the strip being welded together to form a substantially round/oval cross-section flexible tube. The tube is then processed by apparatus described in our aforesaid application to create longitudinally extending creases in the tube wall and hence form a D-section tube which is subsequently cut to the desired length.

Each tubular housing 11, in use, has a closed end which is formed with a fish-tail type seam 16, preferably a welded seam, as is commonly known in the art. The seam is formed after the tubular housings 11 have been filled with their respective contents. The two closed ends may be formed so that each compartment 'C' has a respective seam or the two closed ends may be welded together in a single welded common seam.

Figure 6:
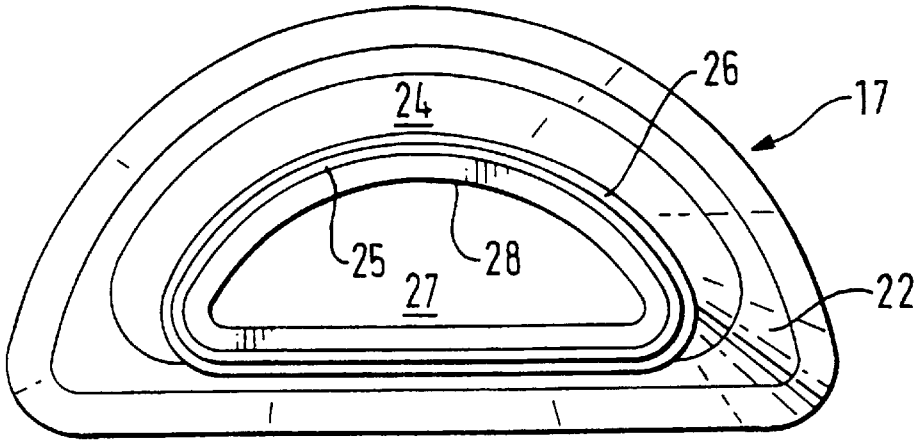
FIG. 6 is a plan view of a shoulder piece as used in the two-compartment container of FIG. 1.

The other end of each tubular housing 11 has a respective shoulder piece 17 located therein. The two shoulder pieces 17 are moulded from a high density polyethylene compound, and have a general D-shaped cross-section as can be seen in FIG. 6.

Figure 3:
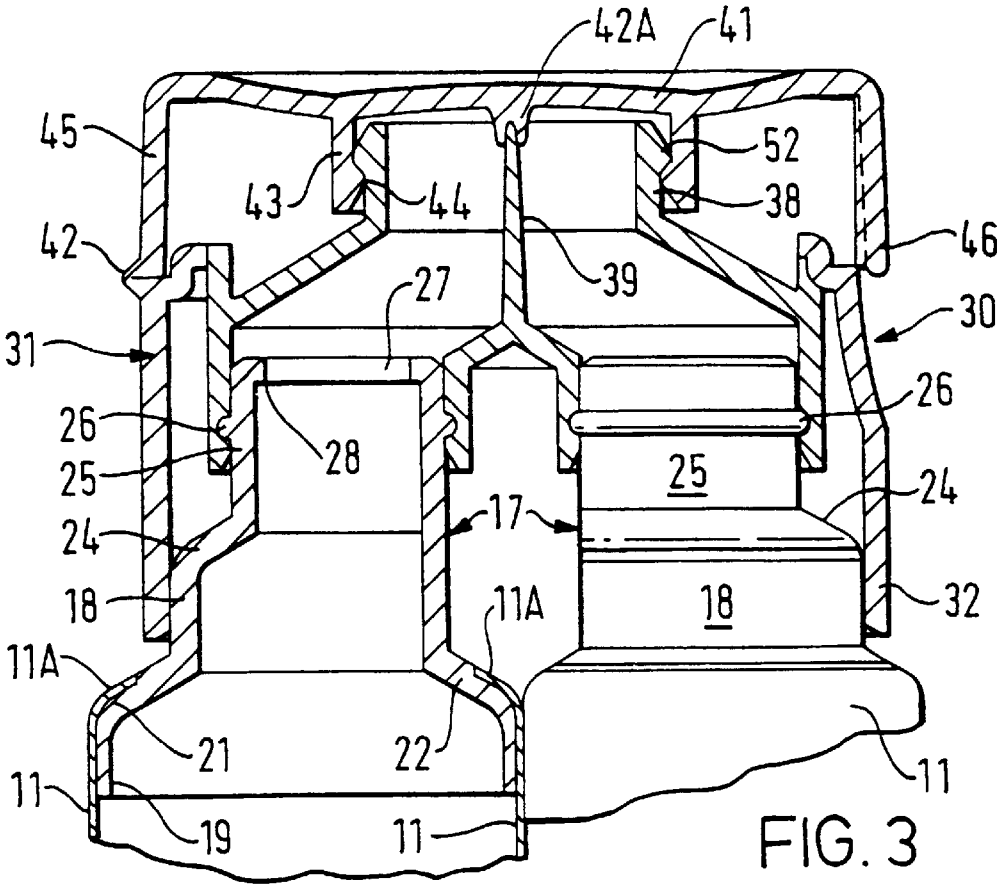
FIG. 3 is an enlarged cross-sectional view of the cap and shoulder piece assembly of FIG. 1.

With reference now to FIG. 3, each D-shaped shoulder piece 17 has a lower D-shaped skirt 19 which is a close fit within an end portion of a respective tubular housing 11. The upper end of the skirt 19 extends into a rounded edge 21 leading into a shoulder 22 tapering inwardly and upwardly away from the skirt 19. The shoulder 22 is slightly recessed to accommodate an end portion 11A of the tubular housing when it is heat-formed and welded to the shoulder piece 17. The inner end of the shoulder 22 has a D-shaped sidewall 18 projecting axially therefrom (that is axially with respect to the axis of the tubular housing). The D-shaped sidewall 18 is coaxial with the skirt 19, and at its upper end on its arcuate side extends into an inwards projecting shoulder 24. A D-shaped nozzle portion 25 extends upwardly from the shoulder 24 and the planar side of sidewall 18 and terminates in a D-shaped mouth 27. Each nozzle 25 has a bead 26 on its outer surface set back from the mouth 27, and an inwardly projecting lip 28 at the mouth 27 whose function will be described later. The bead 26 may be continuous, as shown, or an interrupted bead.

The two tubular housings, with their shoulder pieces 17 affixed therein, are assembled together to form a cylindrical assembly. A cap assembly 30 is fitted over the nozzles 25 of the shoulder pieces to hold the dual chamber assembly together.

The cap assembly 30 (see FIGS. 4 and 5) comprises an annular body 31 with a hinged lid 41. The body 31 has an outer cylindrical skirt 32 and provides a pair of outlet passageways 33. The passageways 33 at their lower ends each have a D-shaped downwardly projecting mouth 34 and at the upper ends a pair of D-shaped outlet ports 40 which form a divided circular outlet 38. The two passageways 33 are spaced from one another with the mouths 34 of the passageways projecting downwardly. The mouth 34 of each passageway has an internal groove 36 therein adjacent the open end of the mouth to form a snap-fit detent for engagement with the bead 26 on the outer surface of a respective nozzle 25.

When the nozzles are inserted into the cap body 31, the mouths 34 of the passageway 33 can expand outwardly (aided by a chamfer 37) until the grooves 36 engage the bead 26.

Since the mouths of the nozzles 25 are reinforced by the lips 28 there is insufficient resilience in the assembly to allow the nozzles to be subsequently easily withdrawn.

When the nozzles 25 have been assembled to the cap 30 the outer skirt 32 closely surrounds the arcuate portions of the sidewalls 18 to support the shoulder pieces in an assembled condition.

The two D-shaped outlet ports 40 at the outlet 38 of the passageways 33 are separated by a substantially diametrical partition 39 between the two D-shaped passageways 33.

The lid 41 is pivoted to the body 31 by an integral hinge 42 and has a central annular sidewall 43 which in use is concentric with the divided outlet 38 and has an annular resilient detent 44 projecting radially inwardly that is engagable with an external bead 52 surrounding the outlet 38 to snap the lid over the outlet when the cap 30 is in a closed condition, and which allows the lid to be opened.

The lid 41 also has an outer annular skirt 45 which in use is substantially in alignment with the outer skirt 32 of the body 31. A portion 46 of the skirt 45 (see FIG. 3) is offset to aid raising of the lid from the body on opening the container.

The lid 41 may have a diametral sealing means 42A (see FIG. 3) located within the central annular sidewall 43 for sealing the two outer passageways from each other if necessary. Alternatively a disc sealing means (eg a resilient pad) can be located within the annular sidewall 43, to seal to the outlet end of the partition 39.

When the closure is in an open condition and both flexible tubular housings 11 are subject to pressure to expel their contents, the contents of the two compartments C will be simultaneously expelled through the respective nozzle 25 and outlet passageway 33. The two separated contents will combine on exiting the outlet 38.

Figure 7:
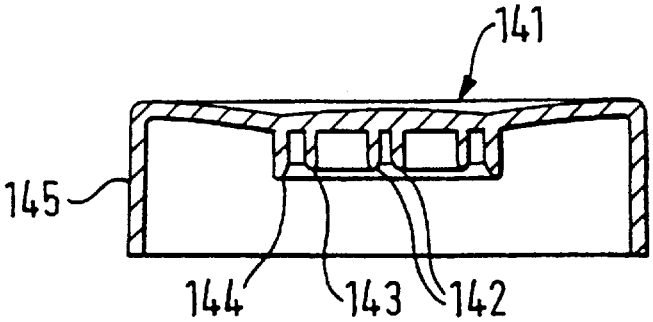
FIG. 7 shows a modified closure lid.
Figure 4:
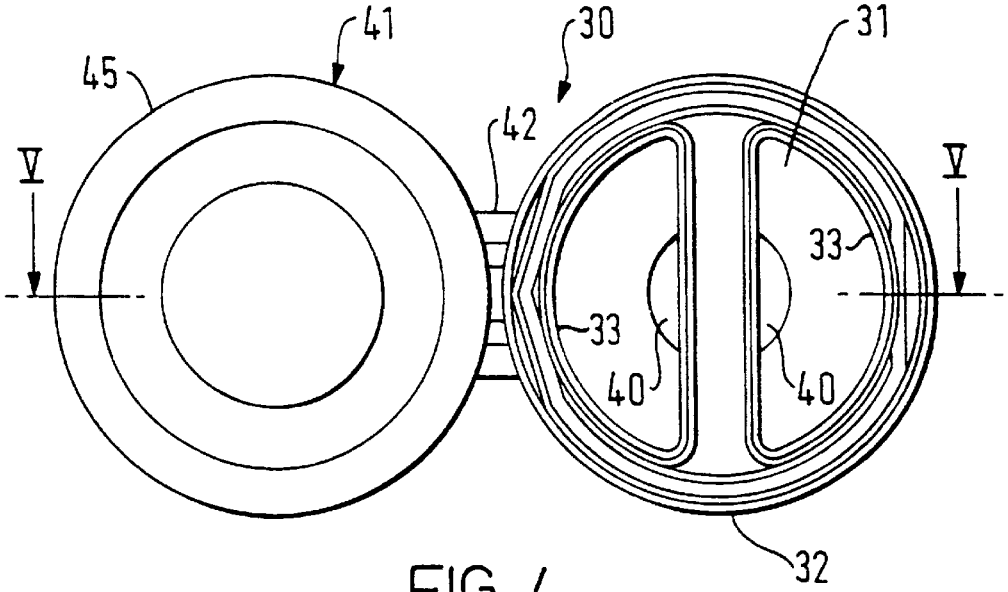
FIG. 4 is a view of the underside of the cap of FIG. 1 shown open.
Figure 5:
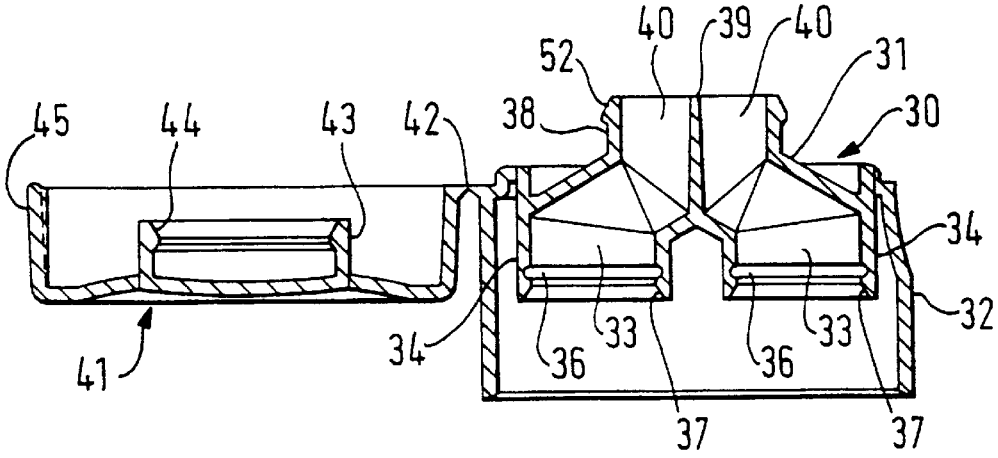
FIG. 5 is a cross-section on the line V—V of FIG. 4.

An alternative design of lid 141 is shown in FIG. 7 which may be hinged to a cap assembly body 31 in just the same way as the lid 41 shown in FIGS. 4 and 5. The modified lid 141 has an outer annular skirt 145 (which aligns with the outer skirt 32 of the body 31) and a pair of radially spaced inner annular ribs 143, 144 on the inside of the cap which are concentric with the outlet 38 so that when the lid 141 is in its closed condition, the sidewalls 143, 144 respectively seal against the inner and outer surfaces of the outlet 38.

A pair of spaced diametrical ribs 142 is also shown in FIG. 7 these being located within the annular ribs 143, 144 and serve to seal on opposite sides of the partition 39 in a similar manner to that shown at 42A in FIG. 3.

What is claimed is:

1. A two-compartment container for paste or other thixotropic material comprising two flexible tubular plastic housings each having a shoulder piece with a discharge nozzle therein located at one end thereof with the other ends of the two tubular housings being formed into a closure seam, wherein each of the two tubular housings has a substantially D-shaped cross-section defined by a pair of longitudinally extending creases, with a substantially flat planar portion extending between the creases in one direction, and an arcuate portion extending between the creases in the other direction, the flat planar portion extending the whole length of the respective tube, and the two tubular housings being held in side-by-side relationship so that the flat planar portions are in contact with each other over substantially their entire widths and lengths.

2. A two-compartment container as claimed in claim 1, in which the two shoulder pieces are also D-shaped and when assembled together present a substantially circular outer periphery, characterised in that each nozzle has a detent means thereon and each nozzle is a snap-fit within a cylindrical cap which also encircles the two assembled shoulder pieces.

3. A container as claimed in claim 2, wherein the cylindrical cap includes two outlet passageways and each nozzle is a snap-fit into a respective outlet passageway.

4. A container as claimed in claim 3, wherein each nozzle has an inwardly projecting lip adjacent the mouth thereof.

5. A container as claimed in claim 3, wherein each nozzle has an outwardly projecting bead on its external surface which is a snap-fit in an internal groove within the respective outlet passageway, the groove being proximate the mouth of the passageway and the bead being set back from the mouth of the nozzle.

6. A container as claimed in claim 3, wherein the two outlet passageways each terminates in a substantially semicircular outlet port, the two outlet ports being located side-by-side to form a divided circular outlet.

7. A container as claimed in claim 2, wherein each shoulder piece comprises a D-shaped skirt which is locatable within a tubular housing and which at its upper end extends into a shoulder which extends inwardly to a D-shaped sidewall, which in turn runs into a D-shaped nozzle so that when the two shoulder pieces are assembled together the flat sides of the two nozzles are spaced from each other.

8. A container as claimed in claim 1, wherein the two tubular housings are formed from laminated layers of polymeric material, and each tubular housing is heat-formed and welded to the shoulder of the respective shoulder piece.

9. A container as claimed in claim 1, wherein the tubular housings are formed from a laminated strip which is rolled into a substantially circular cross-section so that its longitudinal edges overlap to form a tube.

10. A container as claimed in claim 1, wherein the two shoulder pieces each comprise a D-shaped skirt which is locatable within a tubular housing and, at its upper end, extends into a shoulder which extends inwardly, each tubular housing being heat-formed and welded to a respective shoulder.

11. A container as claimed in claim 1, wherein the two nozzles are a snap-fit into a cap, and each nozzle has an inwardly projecting lip adjacent the mouth thereof.

12. A container as claimed in claim 1, wherein the two nozzles are a snap-fit into a cap, said cap having a skirt which surrounds and supports said shoulder pieces after assembly of the two nozzles to the cap.

13. A container as claimed in claim 1, wherein the two nozzles are a snap-fit engagement into a respective outlet passageway in a cap, each outlet passageway having a mouth projecting downwardly of the cap into which the nozzle is inserted, the mouth having detent means for effecting the snap-fit engagement of a respective nozzle and which is located at the distal end of the mouth.

* * * * *